US007578410B2

(12) United States Patent
Stahl et al.

(10) Patent No.: US 7,578,410 B2
(45) Date of Patent: Aug. 25, 2009

(54) LOW DEPTH BOTTLE CRATE

(75) Inventors: Edward Stahl, Tyler, TX (US); Roy Hammett, Odessa, FL (US)

(73) Assignee: Norseman Plastics Limited, Rexdale, Ontario (CA)

( * ) Notice: Subject to any disclaimer, the term of this patent is extended or adjusted under 35 U.S.C. 154(b) by 86 days.

(21) Appl. No.: 10/958,518

(22) Filed: Oct. 4, 2004

(65) Prior Publication Data

US 2005/0072710 A1 Apr. 7, 2005

Related U.S. Application Data

(63) Continuation-in-part of application No. 09/978,576, filed on Oct. 18, 2001, now abandoned.

(51) Int. Cl.
*B65D 1/24* (2006.01)
*B65D 85/62* (2006.01)

(52) U.S. Cl. ..... 220/507; 206/509; 206/519

(58) Field of Classification Search ..... 220/507, 220/516, 519
See application file for complete search history.

(56) References Cited

U.S. PATENT DOCUMENTS

| | | | | |
|---|---|---|---|---|
| 2,760,676 | A * | 8/1956 | Knieriem et al. | 206/511 |
| 4,700,836 | A | 10/1987 | Hammett | 206/427 |
| 4,759,451 | A | 7/1988 | Apps | 211/126.4 |
| 4,899,874 | A | 2/1990 | Apps et al. | 206/201 |
| 4,928,841 | A | 5/1990 | Arthurs | 220/516 |
| 4,932,532 | A | 6/1990 | Apps et al. | 206/503 |
| 4,978,002 | A | 12/1990 | Apps et al. | 206/201 |
| D317,670 | S | 6/1991 | Apps | D3/314 |
| 5,060,819 | A | 10/1991 | Apps | 220/519 |
| D329,932 | S | 9/1992 | Apps | D3/314 |
| 5,184,748 | A | 2/1993 | Apps | 220/519 |
| 5,305,884 | A | 4/1994 | Apps et al. | 206/519 |
| 5,316,172 | A * | 5/1994 | Apps et al. | 220/519 |
| D348,344 | S | 6/1994 | Apps | D3/318 |
| D356,679 | S | 3/1995 | Apps | D3/304 |
| 5,465,843 | A | 11/1995 | Koefelda | 206/507 |
| 5,487,487 | A | 1/1996 | Hammett | 220/509 |
| 5,501,352 | A | 3/1996 | Apps | 220/4.26 |

(Continued)

OTHER PUBLICATIONS

Photographs of bottle crate made by Rehrig Pacific and located in Mexico.*

*Primary Examiner*—Anthony D Stashick
*Assistant Examiner*—Shawn M Braden
(74) *Attorney, Agent, or Firm*—Ungaretti & Harris LLP

(57) ABSTRACT

A low-depth bottle crate has a peripheral wall with upper and lower portions that extends upwardly from a crate bottom. The upper portions include a plurality of substantially U-shaped cut-outs and a plurality of columns defined between the U-shaped cut-outs. A notch may be defined along the external top surface of the plurality of columns. A nesting rib that fits within the notch when the crate is nested may be positioned within the inner area of the plurality of columns. Handle cut-outs in the lower portion of the opposing end walls may define handle bars that extend between two of the plurality of columns. These two columns may include a part that extends above the top surface of the handle bar, the part including an inwardly angled surface. Radius supports may be disposed on the inner surface of the handle to prevent retained bottles from leaning out of the crate.

14 Claims, 10 Drawing Sheets

U.S. PATENT DOCUMENTS

| | | | | |
|---|---|---|---|---|
| D379,121 | S | 5/1997 | Apps et al. | D3/312 |
| 5,651,461 | A | 7/1997 | Apps et al. | 206/503 |
| 5,660,279 | A | 8/1997 | Apps et al. | 206/503 |
| 5,752,602 | A * | 5/1998 | Ackermann et al. | 206/507 |
| D399,060 | S | 10/1998 | Apps et al. | D3/318 |
| D399,061 | S | 10/1998 | Apps et al. | D3/318 |
| 5,855,277 | A * | 1/1999 | Apps et al. | 206/510 |
| 6,186,328 | B1 | 2/2001 | Apps | 206/518 |
| D468,634 | S * | 1/2003 | Hammett | D34/38 |
| D507,880 | S | 8/2005 | Hassell et al. | D3/313 |
| 6,966,442 | B2 | 11/2005 | Hassell et al. | 206/519 |

* cited by examiner

LOW DEPTH BOTTLE CRATE

REFERENCE TO RELATED APPLICATIONS

This application is a CIP of Ser. No. 09/978,576, filed on Oct. 18, 2001, that is now abandoned.

BACKGROUND OF THE INVENTION (1) Field of the Invention

This invention relates to crate constructions for bottles and more specifically, to a low depth crate for 20-24 oz. bottles.

(2) Description of the Related Art

Low depth bottle crates are well known in the art as exemplified by U.S. Pat. Nos. 4,700,836; 4,928,841; 5,060,819; and 5,855,277. These crates typically have side and end walls that extend only about one-third the height of standard 2 liter bottles. This means that, when loaded and stacked, crates rest directly on the bottles in an underlying crate. The low depth of the crate is attractive, however, since it reduces material costs, enhances visibility of the bottles, and reduces shipping space when the crates are stacked empty. Some prior crates employ crate height increasing features to provide greater support for bottles received therein, while still permitting the bottle labels to be seen. Such features may include columns that extend above the side and end walls of the crate as exemplified in U.S. Pat. Nos. 4,899,874; 4,978,002; and 5,501,352.

BRIEF SUMMARY OF THE INVENTION

The crate of this invention includes a peripheral wall (inclusive of side and end walls) of uniform height with substantially U-shaped cut-outs spaced along the side and end walls of the crate. The cut-outs extend from the upper edge of the peripheral wall downwardly to a ledge or shelf than separates the peripheral wall into upper and lower portions. These cutouts in the upper portion of the side and end walls may also be viewed as defining columns or pillars in the upper portion of the side walls, end walls and corners, between the cut-outs. The lower portion is solid about the periphery of the crate with the exception of two cutouts in the end walls extending from the crate bottom upwardly to respective handle bars that are flush with the top surface of the peripheral wall. As such, the handle bars interrupt the otherwise regular occurrence of the cut-outs in the upper portion of the peripheral wall.

The interior of the crate is open, i.e., there are no partitions, columns or other interior structures defining compartments for one or more bottles. Thus, the crate bottom, a grid-like structure described in detail further below, has a flat upper surface throughout the crate interior, but with defined bottle support platforms arranged in four rows of six, that are flush with the upper surface, each platform including a solid annular ring. Thus, the crate is designed to carry twenty-four individual 20-24 oz. bottles.

The peripheral wall is generally of single thickness construction with the exception of certain areas at the tops of the columns and the handle bars that are of double thickness as described below.

The interior of the lower portion of the peripheral wall is joined to the crate bottom directly below respective cut-outs in the upper peripheral wall portion by three vertical, inwardly projecting ribs. The two outside ribs of each group of three ribs merge with edge surfaces of adjacent columns. The upper (approximate) ⅓ of the columns is of double thickness, forming a closed "cap" on the top of each column. For the columns along the side and end walls, an internal support buttress extends from the lower edge of the cap downwardly and at an acute angle relative to vertical, joining with the crate bottom well inwardly of the lower portion of the peripheral wall and the three vertical ribs between adjacent columns. Since the bottle support platforms are generally aligned with the cut-outs, the buttresses extend partially between adjacent support platforms and thus provide some support for individual bottles located along the side and end walls of the crate. The corner columns are generally similar, but do not include the internal buttresses.

The handle bars are also of double thickness and extend between a pair of columns in the respective end walls. A support strut and pedestal arrangement connects the center of each handle bar directly to the crate bottom.

The lower surface of the crate bottom is formed with recesses aligned with the bottle support platforms on the upper surface, thus providing defined spaces for the caps of bottles in an underlying crate when similar filled crates are stacked. The recesses each have a flat base area that is larger than a respective bottle cap, but the recesses are not all of the same configuration. Rather, there is a symmetrical array of partially circular recesses.

Specifically, the lower surface of the crate bottom is arranged in four quadrants, each a mirror image of the adjacent quadrants along the longitudinal and transverse axes. Within each quadrant, the undersides of the six bottle supporting platforms are different in terms of rib height, but similar in terms of overall grid configuration. Annular ribs depending from each bottle supporting platform generally have a maximum rib height that coincides with the bottom surfaces of the grid that engage a supporting surface. In the instant invention, the annular ribs are formed to have some circumferential portion reduced in height so as to be contiguous or flush with reduced height ribs both inside and outside the annular ribs thereby providing additional selectively oriented spaces for the bottle caps to slide in an uninhibited manner. This arrangement facilitates dragging of an upper, filled crate off a lower filled crate when stacked.

More specifically, the height of the annular rib defining one recess (adjacent one side wall and the transverse axis of the crate) is decreased through an angle of slightly more than 90.degree. along a portion facing the nearest side wall, thus permitting a respective bottle cap to slide across the rib and laterally toward the nearest side wall.

The next adjacent recess along the side wall in the direction of the nearest end wall is defined by an annular rib that is decreased in height through approximately 180° along portions facing the nearest side and end walls, such that the bottle cap is free to move transversely toward that side wall, and longitudinally toward but not into the next adjacent recess.

The next adjacent recess in the nearest corner of the crate is defined by a rib that is decreased in height through about 200° also along portions facing the nearest side and end walls. A respective bottle cap is thus free to move transversely toward side the nearest wall and longitudinally toward the nearest end wall.

The above described recesses lie in one row of one quadrant, extending from the transverse axis along the side wall to an end wall. The second row of the quadrant extending from the transverse axis to the same end wall but along the longitudinal axis (and adjacent the first row in the longitudinal direction) has recesses that are generally similar to adjacent recesses in the first row, but with slight differences in the angles through which the reduced height annular ribs extend as dictated by the grid pattern of the crate bottom.

The overall symmetrical pattern of recesses generally centers one filled crate atop another, but allows movement of underlying bottle caps within defined areas and thus facilitates the dragging of one filled crate off another filled crate.

Accordingly, in one aspect, the invention relates to a low depth bottle crate having a peripheral wall of uniform height, the peripheral wall including a pair of side walls and a pair of end walls; a crate bottom connected to the peripheral wall, an upper surface of the crate bottom formed to include a bottle supporting platform for each bottle to be received in the crate; a plurality of substantially U-shaped cut-outs in upper portions of the side and end walls defining columns between the cut-outs, lower portions of the peripheral wall and the columns being of single wall construction except for hollow caps at upper ends of the columns that are of double wall construction; each of the columns, except for four corner columns, having a support buttress extending downwardly and inwardly from a lower edge of a respective one of the hollow caps to the crate bottom, and wherein the cut-outs terminate at a ledge that separates the upper portions of the side and end walls from the lower portions of the side and end walls, and further wherein the lower portions of the side and end walls are connected to the crate bottom by a plurality of inwardly directed ribs arranged in groups, directly below each cut-out.

In another aspect, the invention relates to a low depth bottle crate having a peripheral wall of uniform height, said peripheral wall including a pair of side walls and a pair of end walls; a crate bottom connected to said peripheral wall, an upper surface of the crate bottom formed to include a bottle supporting platform for each bottle to be received in the crate; a plurality of substantially U-shaped cut-outs in upper portions of the side and end walls defining columns between the cut-outs, the cut-outs terminating at a ledge that separates the upper portions of the side and end walls from lower portions of the side and end walls, and wherein handle cut-outs are provided in lower portions of the end walls, defining handle bars that extend between adjacent columns in the end walls directly above the handle cut-outs, each handle bar connected directly to the crate bottom at a mid-point of the handle bar.

In still another aspect, the invention relates to a low depth bottle crate having a peripheral wall of uniform height, the peripheral wall including a pair of side walls and a pair of end walls; a crate bottom connected to the peripheral wall, an upper surface of the crate bottom formed to include a bottle supporting platform for each bottle to be received in the crate; a plurality of substantially U-shaped cut-outs in upper portions of the side and end walls defining columns between the cut-outs, lower portions of the peripheral wall and the columns being of single wall construction except for hollow caps at upper ends of the columns that are of double wall construction; wherein handle cut-outs are provided in lower portions of the end walls, and handle bars extend between adjacent columns in the end walls directly above the handle cut-outs, each handle bar connected directly to the crate bottom; and the crate bottom having a lower surface formed with an array of recesses adapted to engage bottle caps of bottles carried in an underlying similar crate, the recesses in each of four quadrants being individually different but substantial mirror images of recesses in adjacent quadrants in respective longitudinal and transverse directions.

In another aspect, the invention relates to a low-depth bottle crate having a crate bottom, the crate bottom having an upper surface and a lower surface, the upper surface being devoid of any interior columns, a peripheral wall joined with and extending upwardly from the crate bottom, the peripheral wall including a pair of opposing side walls and a pair of opposing end walls, each of the opposing side and end walls having an upper and a lower portion, the upper portion of said opposing side and end walls including a plurality of substantially U-shaped cut-outs, a plurality of columns each of which are defined between two of said plurality of substantially U-shaped cut-outs, each of the plurality of columns having an external top surface and an internal area, a notch defined along the external top surface of one or more of said plurality of columns, and a nesting rib located within the internal area of one or more of said plurality of columns, said nesting rib positioned above the lower surface of said crate bottom and below the external top surface of said plurality of columns, the nesting rib fitting within said notch when the crate is nested on top of an identical empty crate.

In another aspect, the invention relates to a low depth bottle crate having a crate bottom, the crate bottom having an upper surface and a lower surface, the upper surface being devoid of any interior columns, a peripheral wall joined with and extending upwardly from said crate bottom, the peripheral wall including a pair of opposing side walls and a pair of opposing end walls, each of said opposing side and end walls having an upper and a lower portion, the upper portion of the opposing side and end walls including a plurality of substantially U-shaped cut-outs, a plurality of columns each of which are defined between two of said plurality of substantially U-shaped cut-outs, each of the plurality of columns having an external top surface and an internal area, handle cut-outs provided in the lower portions of the end walls, the handle cut-outs defining handle bars that extend between two of said plurality of columns in the end walls, the handle bars disposed directly above said handle cut outs, the handle bar including an inner surface and radius supports disposed on said inner surface of said handle bar, said radius supports adapted to provide support for retained bottles.

In another aspect, the invention relates to a low depth bottle crate having a crate bottom, the crate bottom having an upper surface and a lower surface, the upper surface being devoid of any interior columns, a peripheral wall joined with and extending upwardly from the crate bottom, the peripheral wall including a pair of opposing side walls and a pair of opposing end walls, each of the opposing side and end walls having an upper and a lower portion, the upper portion of the opposing side and end walls including a plurality of substantially U-shaped cut-outs, a plurality of columns each of which are defined between two of the plurality of substantially U-shaped cut-outs, each of said plurality of columns having an external top surface and an internal area, handle cut-outs provided in the lower portions of the end walls, the handle cut-outs defining handle bars that extend between two of the plurality of columns in the end walls, the handle bars disposed directly above said handle cut outs, the handle bars including a top surface, said two of said plurality of columns including a part that extends above the top surface of the handle bar.

In yet another aspect, the invention relates to a low depth bottle crate having a crate bottom, the crate bottom having an upper surface and a lower surface, the upper surface being devoid of any interior columns, a peripheral wall joined with and extending upwardly from the crate bottom, the peripheral wall including a pair of opposing side walls and a pair of opposing end walls, each of the opposing side and end walls having an upper and a lower portion, the upper portion of the opposing side and end walls including a plurality of substantially U-shaped cut-outs, a plurality of columns each of which are defined between two of said plurality of substantially U-shaped cut-outs, each of the plurality of columns having an external top surface and an internal area, handle cut-outs provided in the lower portions of said opposing end walls, the handle cut-outs defining handle bars that extend between two of said plurality of columns in said opposing end walls, the handle bars disposed directly above said handle cut outs, the handle bars including an inner surface and a means for preventing bottles from leaning out of the crate disposed on said inner surface of said handle bars.

BRIEF DESCRIPTION OF THE DRAWINGS

For the purpose of illustrating the invention, the drawings show a form of the invention that is presently preferred. However, it should be understood that the present invention is not limited to the precise arrangements and instrumentalities shown in the drawings, wherein.

DETAILED DESCRIPTION OF THE INVENTION

Figure 1:
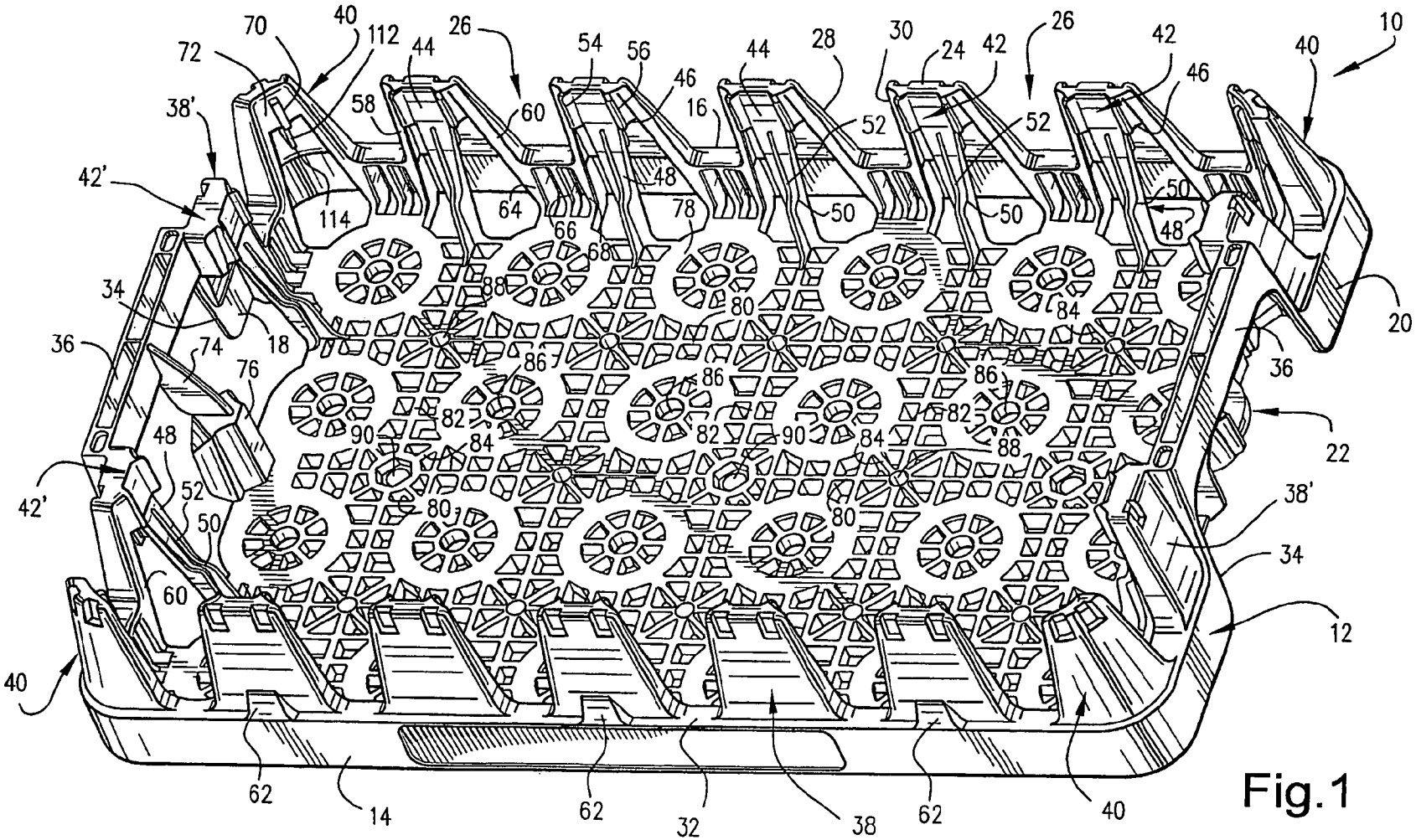
FIG. 1 is a perspective view of the crate in accordance with the invention.

With reference initially to FIGS. 1-5, the crate 10 in the exemplary embodiment is a one-piece molded plastic construction and has a peripheral wall 12 that includes a pair of side walls 14, 16 and a pair of end walls 18, 20. The peripheral wall 12 is of uniform height, extending from a crate bottom 22 to an intermittent or discontinuous exterior top surface 24. The latter is created by a series of U-shaped cut-outs 26 that are spaced about the peripheral wall, with six such cut-outs in each of the respective side walls 14, 16 and two in each of the respective end walls 18, 20. The cut-outs 26 reduce the weight of the crate and also provide good visibility with respect to labels on individual bottles in the crate. In this regard, the cut-outs 26 are centered on individual bottle support platforms formed in the crate bottom, with two mutually perpendicular cutouts for the support platforms in the corners of the crate. Each cut-out in the side and end walls has a pair of inclined, substantially straight sides 28, 30 that extend downwardly from the discontinuous exterior top surface 24 to a shelf or ledge 32 that separates the peripheral wall into upper and lower portions. The lower portion is solid about the periphery of the crate, with interruptions only in the end walls where handle cut-outs 34 extend from the crate bottom 22 upwardly to handle bars 36 that allow the crate to be grasped at opposite ends.

The cut-outs 26 may also be said to define a plurality of columns or pillars 38 along the side walls and 38' along the end walls that extend upwardly from the shelf or ledge 32, terminating at the exterior top surface 24 of the peripheral wall. In the exemplary embodiment, there are five columns 38 along each side wall, two columns 38' along each end wall, and one column 40 in each of the four corners of the crate. With exceptions explained below relating to the end wall and corner columns 38', 40, respectively, the structure of all of the columns 38, 38' and 40 is substantially identical, and therefore, only one need be described in detail. Thus, with particular reference to FIGS. 1, 4, 6 and 7, each column 38 is of generally single wall construction. The upper portion of the column is formed as a hollow cap 42 by making approximately the upper one third of the column of double thickness, with exterior top surface 24 connecting the outer surface of the column to an inner surface 44. From the lower edge 46 of the inner surface 44, a support buttress 48 extends downwardly and inwardly at an acute angle to the column. An inward step 50 and a rib 52 that runs the length of the buttress, provide added strength. Two additional ribs 54, 56 on the inner surface 44 of the hollow cap strengthen the cap but also face toward, and provide support for, bottles on adjacent support platforms. Note also that side edges 58, 60 of the columns 40 wrap around the shelf or ledge 34 to provide additional stiffness to the columns.

Figure 2:
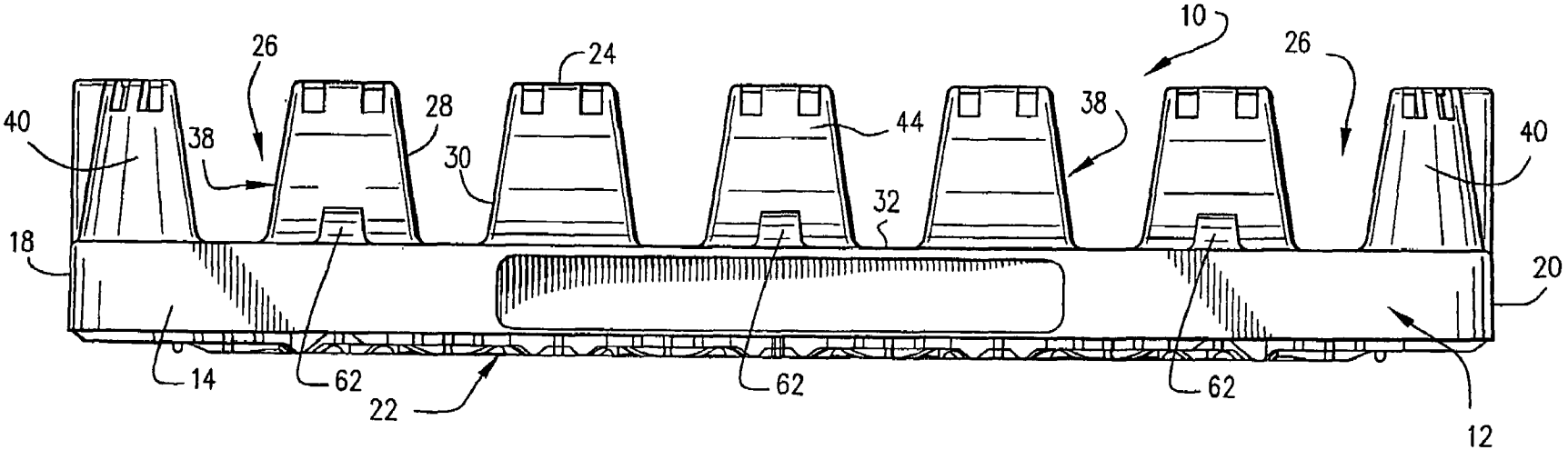
FIG. 2 is a right side elevation view of the crate shown in FIG. 1.
Figure 3:
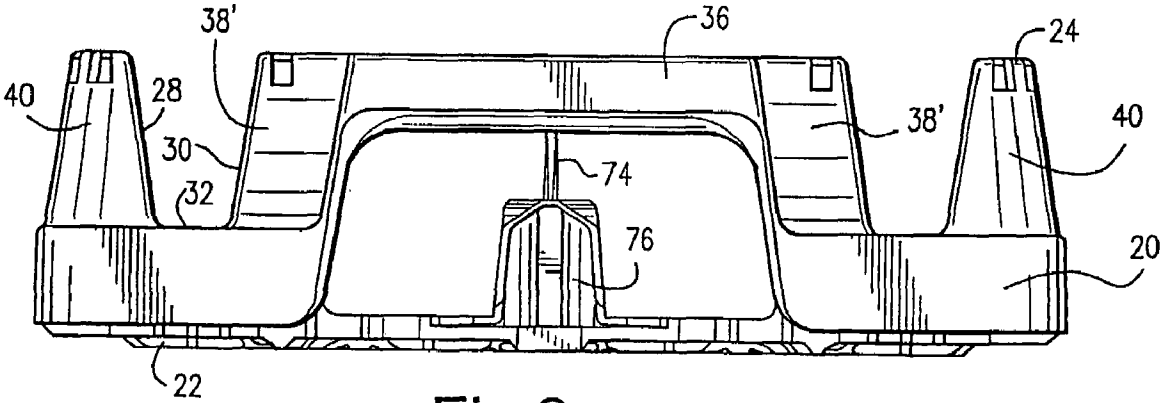
FIG. 3 is aright end view of the crate shown in FIG. 1.
Figure 4:
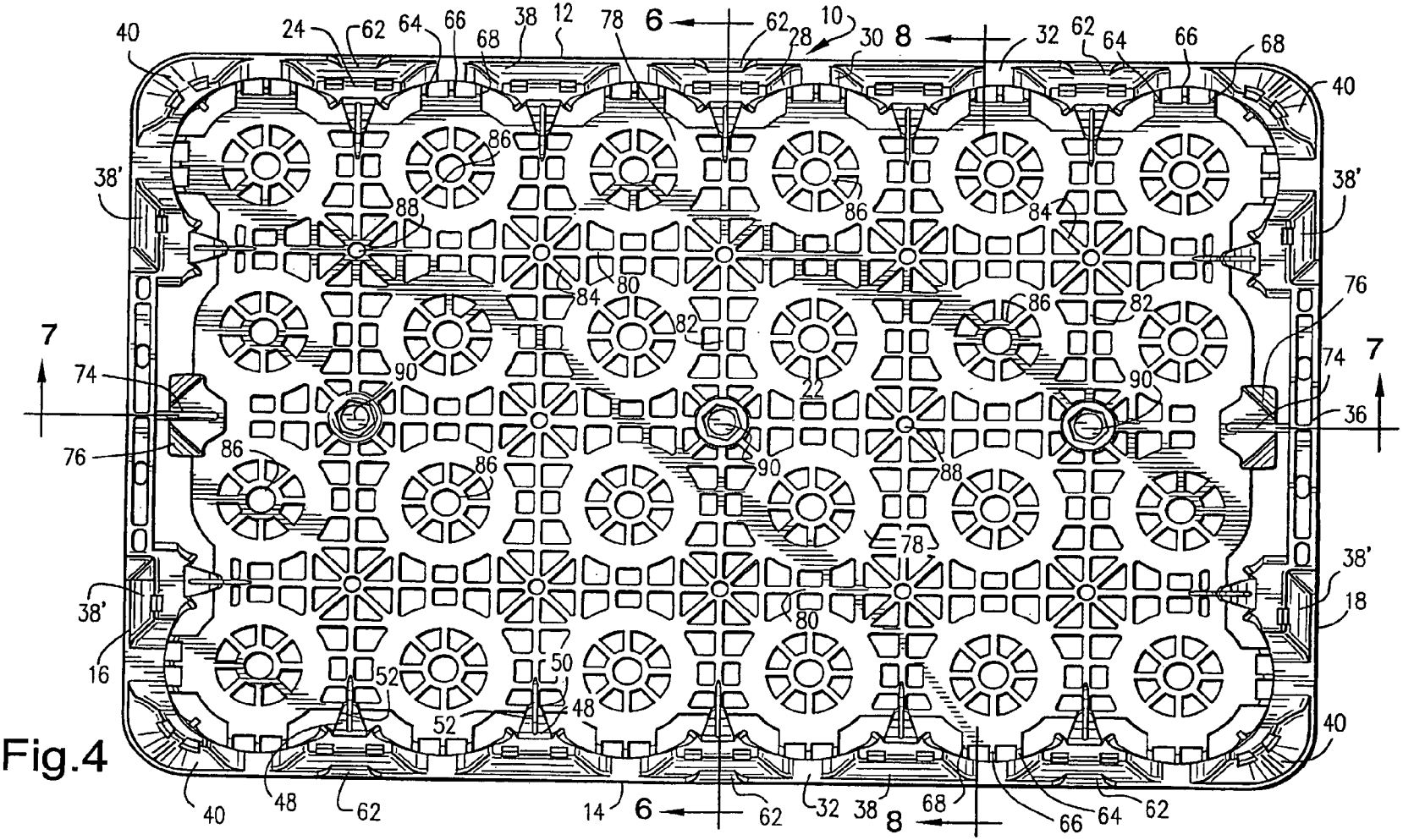
FIG. 4 is a top plan view of the crate in FIG. 1.

With reference especially to FIGS. 1 and 2, wedge "slides" 62 are provided in alternating columns along the side walls. These "slides" bridge the upper and lower portions of the side walls, essentially eliminating the ledge 32 at these locations, and thus providing a smooth transition between the upper and lower portions of the side walls. This arrangement allows one crate side wall to slide down an underlying crate side wall without interference from ledge 24, when individual crates are removed from a stack of similar crates.

Figure 7:
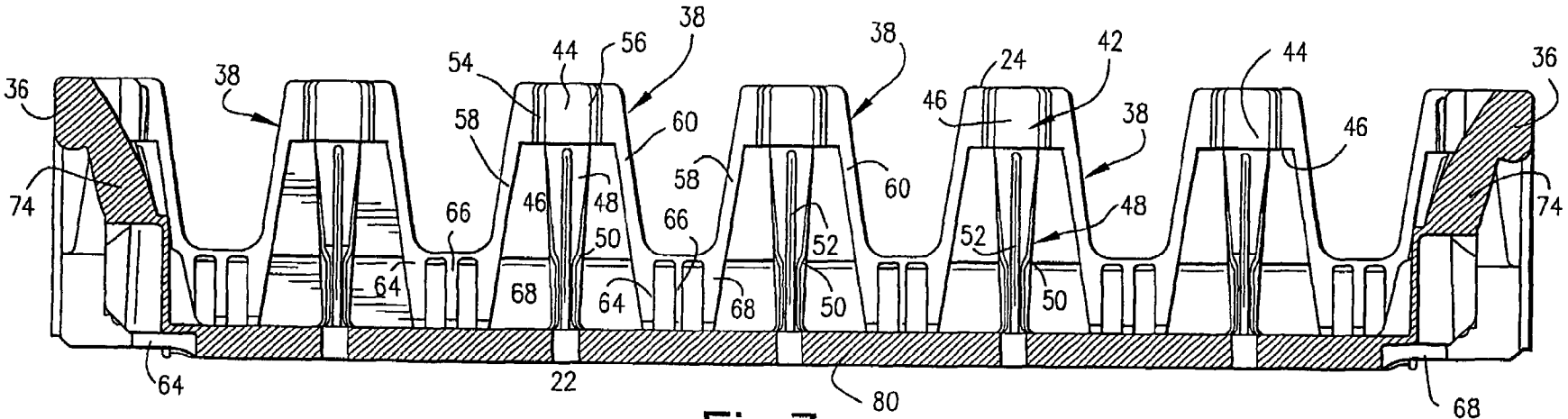
FIG. 7 is a section taken along the line 7-7 of FIG. 4.

Between each pair of adjacent columns 38 (and between respective corner and end wall columns 40, 38'), the lower portions of the side walls 14, 16 and end walls 18, 20 are connected to the crate bottom 22 by groups of three laterally spaced, substantially L-shaped ribs 64, 66 and 68, extending between the shelf or ledge 32 and the crate bottom 22. The "outside" ribs 64 and 68 merge with respective edges 58, 60 of the adjacent columns, as best seen in FIGS. 1 and 7. This generally open arrangement of ribs along the interface of the peripheral wall and crate bottom facilitates drainage but also provides the required strength with reduced amounts of plastic material.

The columns 40 that are in the four corners of the crate do not have support buttresses, and have only a single rib 70 on an inner surface 72 of the respective hollow caps, as best seen in FIG. 1. The columns 38' that are formed in the end walls 18, 20 do have support buttresses 48 but have only one side edge 60, the other side edge removed to accommodate the end wall handle cutouts 34 and handle bars 36. Note that the handle bars 36 extend between and are flush with the top surface 24 of the crate as defined by the hollow caps 42' of the end wall columns 38'. A reinforcement or support strut 74 extends downwardly from the middle of each handle bar 36 to an upwardly projecting, substantially hollow pedestal 76 that is integral with the crate bottom 22. The combination of the strut 74 and pedestal 76 provides stiffness and strength to the handles and to the crate end walls.

The interior of the crate is open in that there are no partitions or other internal structures that might otherwise serve to divide the crate interior into bottle receiving pockets or compartments. The crate bottom 22 is a grid like structure comprised of longitudinal, transverse and diagonal ribs along with solid annular rings as described further below. The upper surface of the crate bottom is flat and smooth across substantially the entire interior of the crate, save where the buttresses 48 join with the outer periphery of the crate bottom, well inwardly of the respective groups of three substantially L-shaped ribs 64, 66 and 68. The flat grid structure nevertheless defines bottle receiving platforms that include solid, outer annular rings 78 that are engaged by respective bottles. The rings 78 are connected by a regular array of longitudinal, transverse, and diagonal ribs 80, 82 and 84, respectively, that create a generally open bottom that also prevent liquids and small debris from collecting in the crate. These ribs extend through the outer annular rings 78 and converge at an inner annular ring 86 at the center of each platform. At the center of each group of four surrounding platforms, certain of the ribs 80, 82 and 84 converge at drainage holes 88 or 90. All of the diagonal ribs are radially oriented relative to the center rings 86 of the various platforms.

In the exemplary embodiment, the crate bottom is formed to include four longitudinal rows with six platforms in each row. Thus, the crate is designed to carry 24 bottles, individually or in six pack carriers. Note, however, that if six pack carriers are utilized, they cannot be of the conventional cardboard type that have side and end walls connected to a carrier bottom. Such traditional six pack carriers will not fit in the exemplary crate due to the inwardly projecting buttresses 50. Shrink wrap carriers of the type that attach only to the upper portions of the bottles may be used, however, and the buttresses 50 can thus extend between lower portions of adjacent bottles, unencumbered by any carrier surface.

Figure 5:
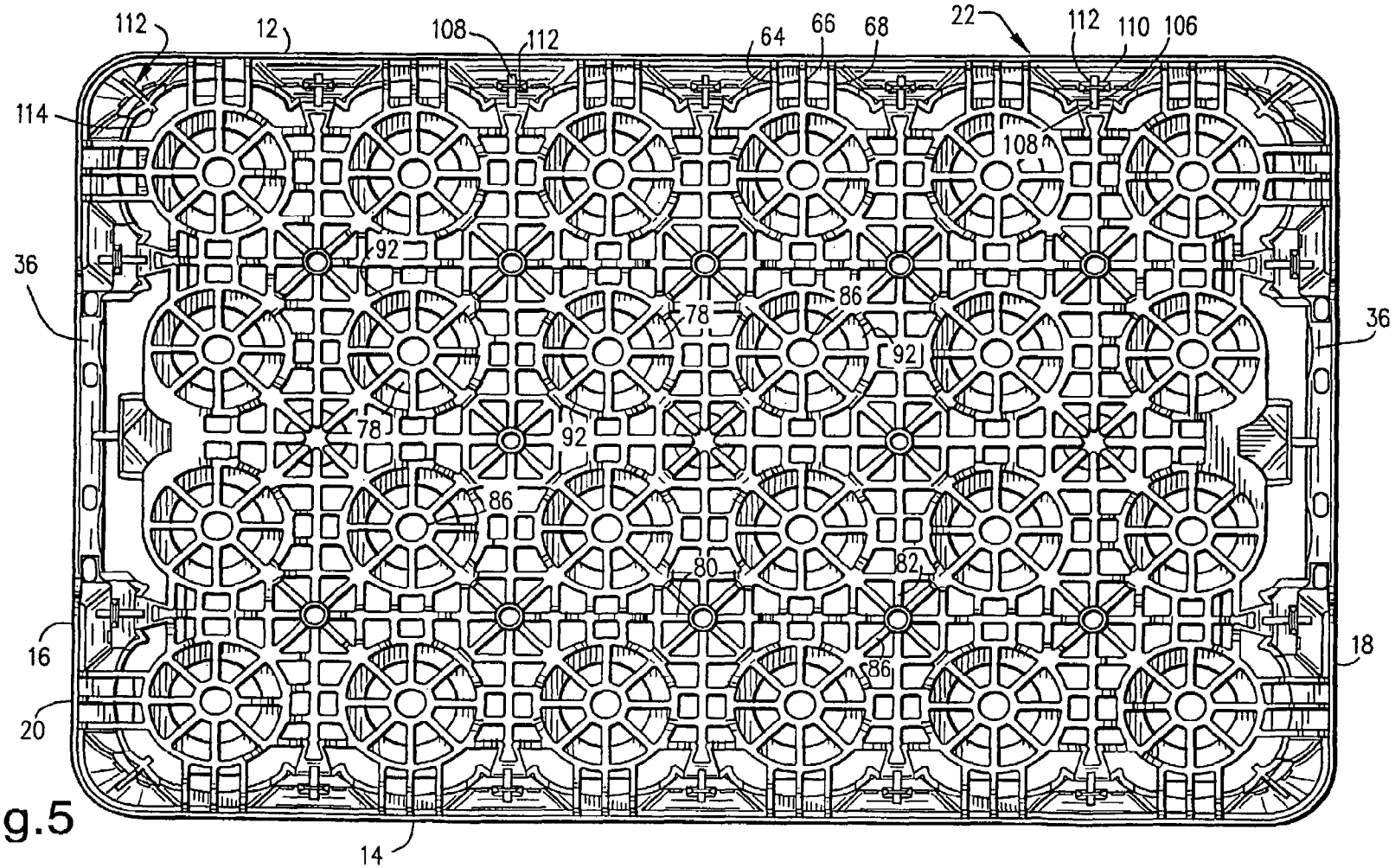
FIG. 5 is a bottom plan view of the crate shown in FIG. 1.
Figure 8:
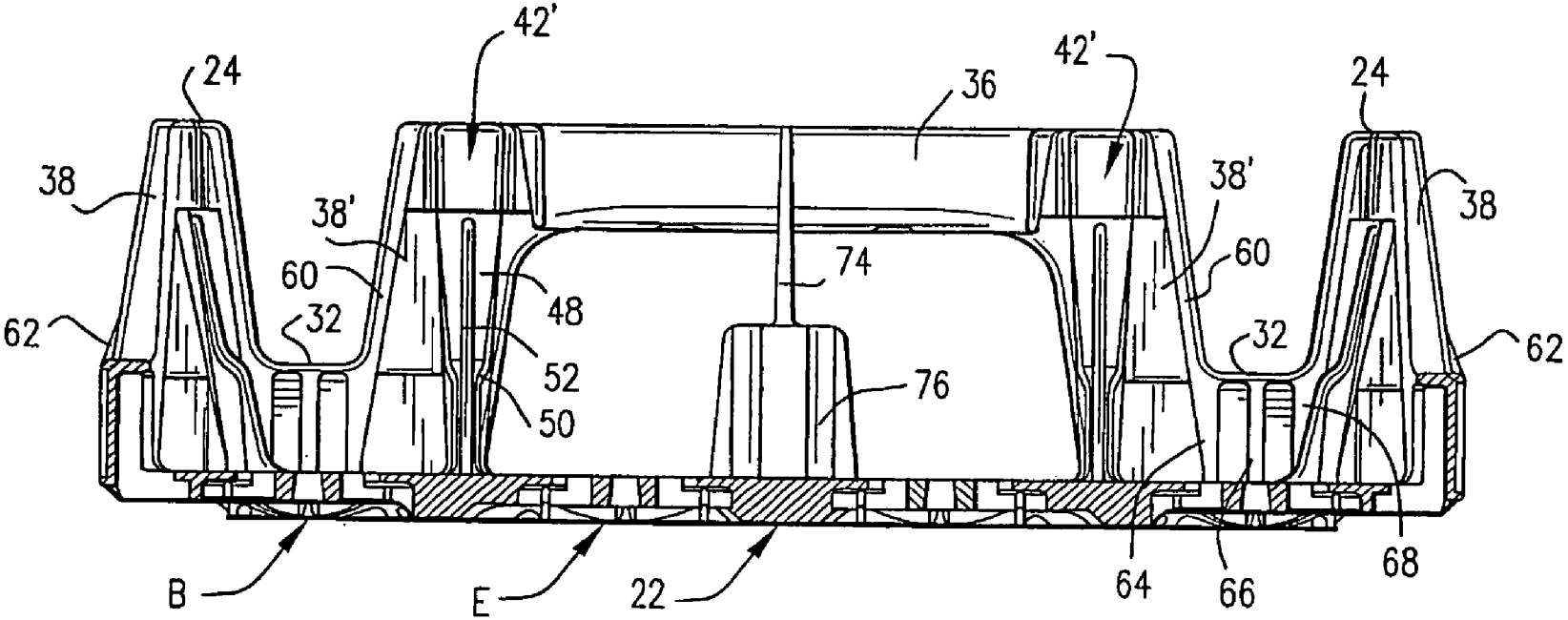
FIG. 8 is a section taken along the line 8-8 of FIG. 5.
Figure 9:
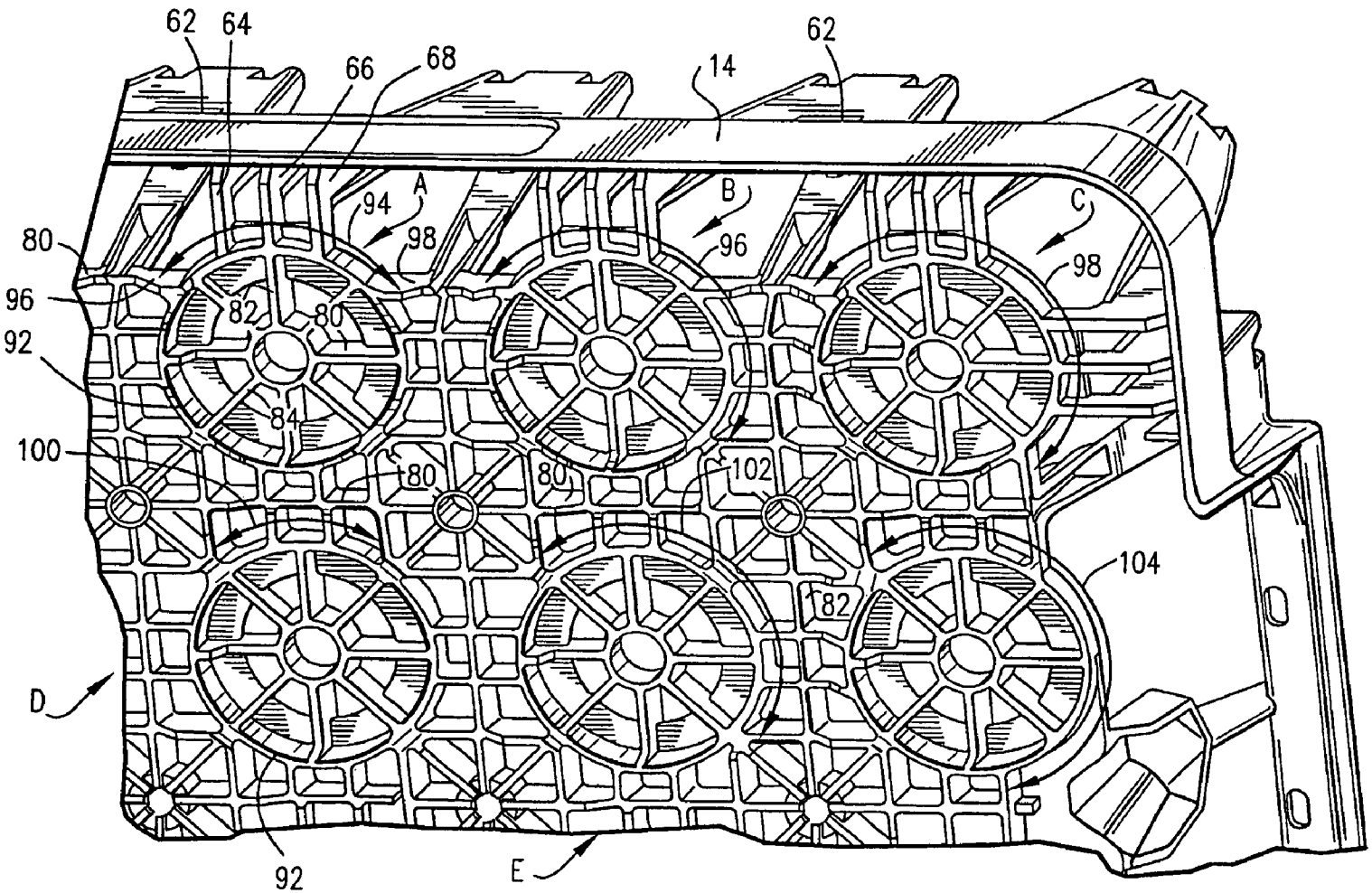
FIG. 9 is a partial bottom perspective view of one quadrant of the crate shown in FIGS. 1-5.

With specific reference to FIGS. 5, 8 and 9, the lower surface of the crate bottom 22 can be viewed as divided into four quadrants, each a mirror image of the adjacent quadrants along both the longitudinal and transverse axes. Within each quadrant, the undersides of the six bottle supporting platforms are different in terms of rib height, but similar in terms of overall configuration. Maximum rib height coincides with the bottom surfaces of the grid that engage a supporting surface and that define recessed areas that are designed to receive bottle caps of bottles in an underlying crate when stacked. In other words, with the exception of the recessed areas, most of the ribs in the grid are substantially of maximum height. Thus, if the outer annular ribs 92 (that depend from the underside of the radially outer edge of outer rings 78 that form the support platforms on the upper surface of the crate bottom) were of maximum height about a full 360°, and if the ribs within each ring were of lesser height, the bottle caps would be confined within circular recesses bounded by the outer annular ribs 92. In the instant invention, however, the outer annular ribs 92 are formed to have some circumferential portion reduced in height so as to be contiguous with reduced height ribs inside the annular ribs 92, as well as selected of the ribs 80, 82, 84 beyond or outside the annular ribs, thereby providing additional selectively oriented spaces for the bottle caps to slide in an uninhibited manner. The overall pattern in the four mirror image quadrants, however, serves to generally center one filled crate atop another filled crate, but also facilitates dragging of an upper filled crate off a lower filled crate.

Specifically, and with reference to FIG. 9, one quadrant of the undersurface of the crate is shown. For convenience, the bottle cap receiving areas defined in part by annular ribs 92 are designated A, B, C, D, E and F. For ease of understanding, the periphery of each recessed area has been drawn with darker lines. The height of rib 92 in area A in the first row of the quadrant is decreased through an angle of slightly more than 90° as indicated by the arrow 94 in an area adjacent the side wall 14. Thus, annular rib 92 between portions 96, 98 of one of the longitudinal ribs 80 is the same height as the ribs 80, 82 and 84 inside the annular rib 92 and the same height as the bottom surfaces of ribs 64, 66 and 68, thus permitting a bottle cap to slide across rib 92 and laterally toward (and beyond) the side wall 14 within this open area. Note in this regard that ribs 64, 66 and 68 in all cases are of reduced height and thus do not engage any supporting surface.

For platform B, the annular rib 92 is decreased in height through approximately 180° as indicated by arrow 96, such that the bottle cap is free to move transversely toward (and beyond) the side wall 14 and longitudinally toward (but not into) the next adjacent area C.

For platform C, the annular rib 92 is decreased in height through about 200° as indicated by arrow 98, and is thus free to move transversely toward (and beyond) side wall 14 and longitudinally toward (and beyond) the end wall 20.

Receiving area D in the second row of the quadrant is generally similar to receiving area A but lies inboard, adjacent the longitudinal axis. The annular rib 92 has a reduced height through about an 85° angle indicated by arrow 100. The bottle cap is confined, however, by longitudinal rib 80 running the two rows of the quadrant in the longitudinal direction.

Area E is generally similar to adjacent area B, but also lies inboard, adjacent the longitudinal axis of the crate. The annular rib 92 is reduced in height through about 180.degree., as indicated by arrow 102, with the open area generally facing diagonally toward area C. Within the 180.degree. area, the bottle cap is free to move beyond rib 92 in both longitudinal and transverse directions, but confined by longitudinal and transverse ribs 80, 82 between adjacent recesses.

Area F is similar to adjacent area C, with rib 92 reduced through about 200° as indicated by arrow 104. Area F is thus open in the longitudinal direction toward the nearest handle opening 34, and open in the transverse direction to the longitudinal rib 80 between the first and second rows of the quadrant, and open into the corner area.

In all cases, the reduction in height of the annular ribs 92, or other ribs that confine the bottle caps, is achieved through a taper as opposed to a sharp shoulder. This further enhances the capability of an upper crate to slide across a lower crate.

Figure 6:
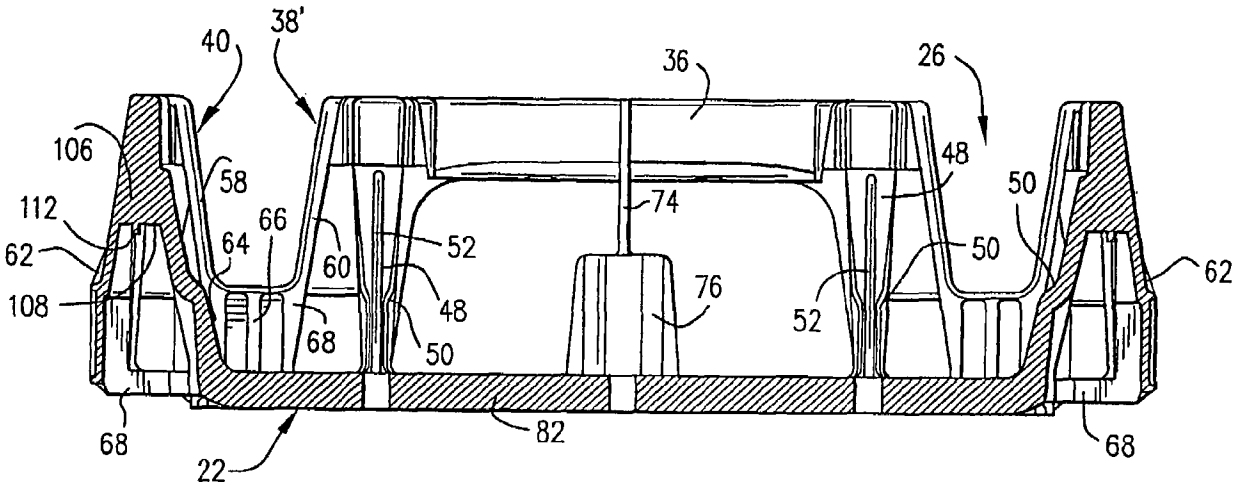
FIG. 6 is a section taken along the line 6-6 of FIG. 4.

When empty, the crates 10 are nestable, with the columns of an underlying crate extending upwardly through spaces in the crate bottom below the columns in the overlying crate. Referring to FIGS. 5 and 6, vertically extending, transversely oriented nesting ribs 106 are engaged between the inner surfaces of the columns 38 and the inner surfaces of the buttresses 48, and extend below the hollow caps 42, 42', terminating at lower edges 108. Nesting ribs 106 are bisected by vertically extending, longitudinally oriented ribs 110 that extend just beyond lower edges 108 of nesting ribs 106, terminating at edges 112. The exterior top surfaces 24 of underlying columns will thus engage lower edges 108 between ribs 110 and the inside surface of the buttresses 48 when stacked empty. Similar nesting ribs are provided in the end columns 38. Corner columns 40 are provided with single, radially oriented nesting ribs 112 that extend between the hollow caps and corner surfaces, with edges 114 at the same height as edges 108 to thereby engage corner columns of an underlying crate.

Figure 10:
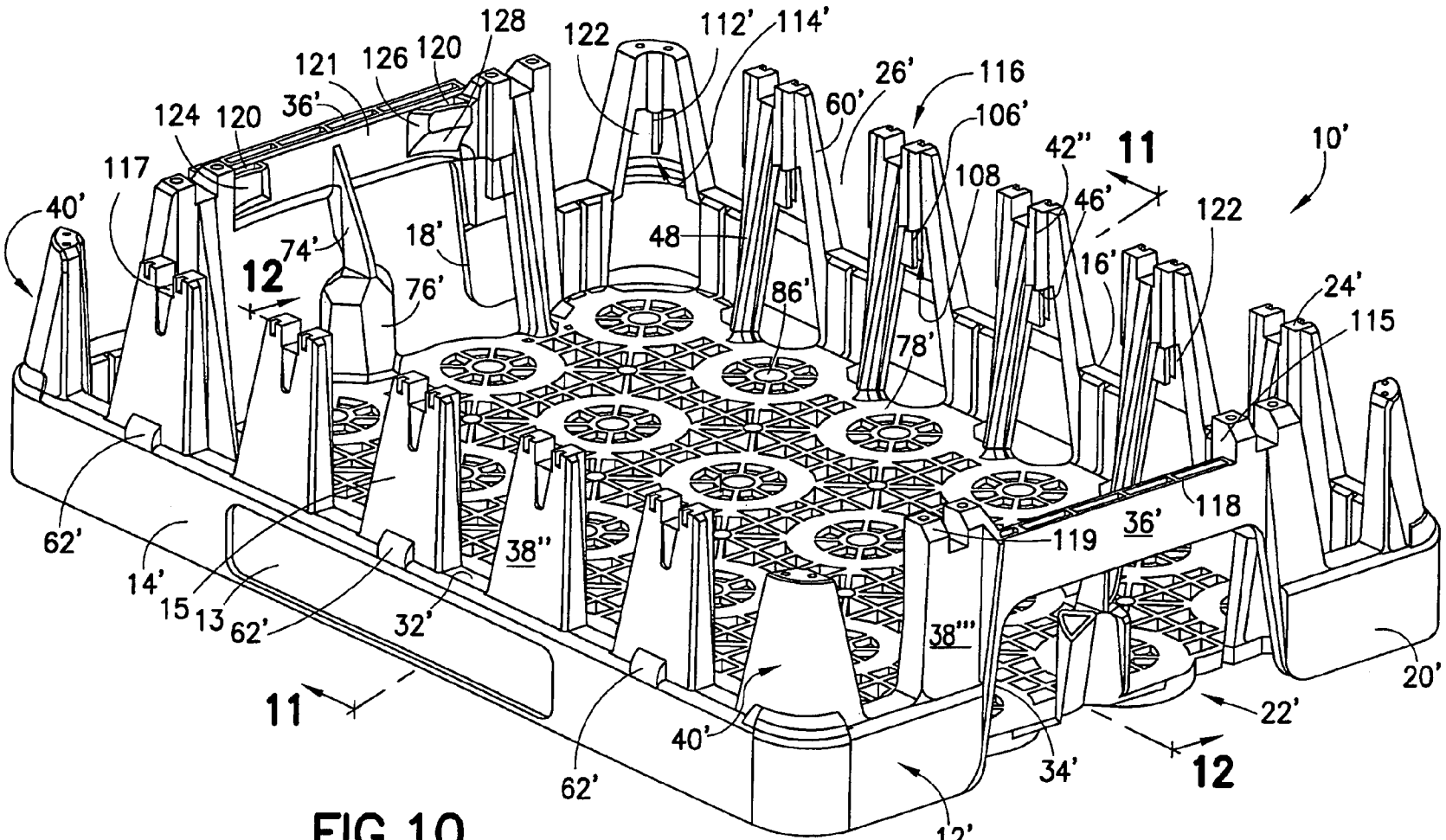
FIG. 10 is a perspective view of the crate according to one embodiment of the invention.
Figure 11:
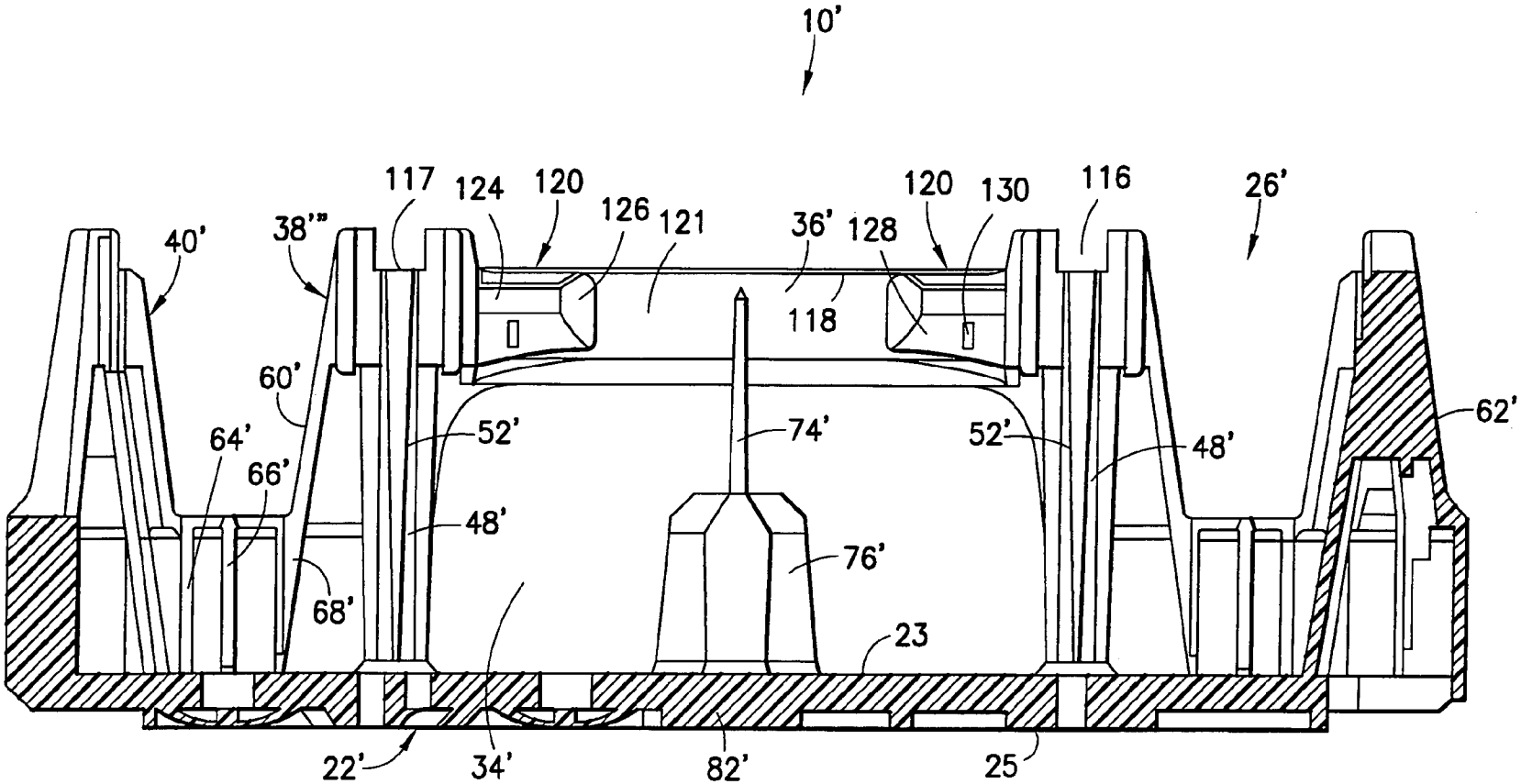
FIG. 11 is a section taken along the line 11-11 of FIG. 10.
Figure 12:
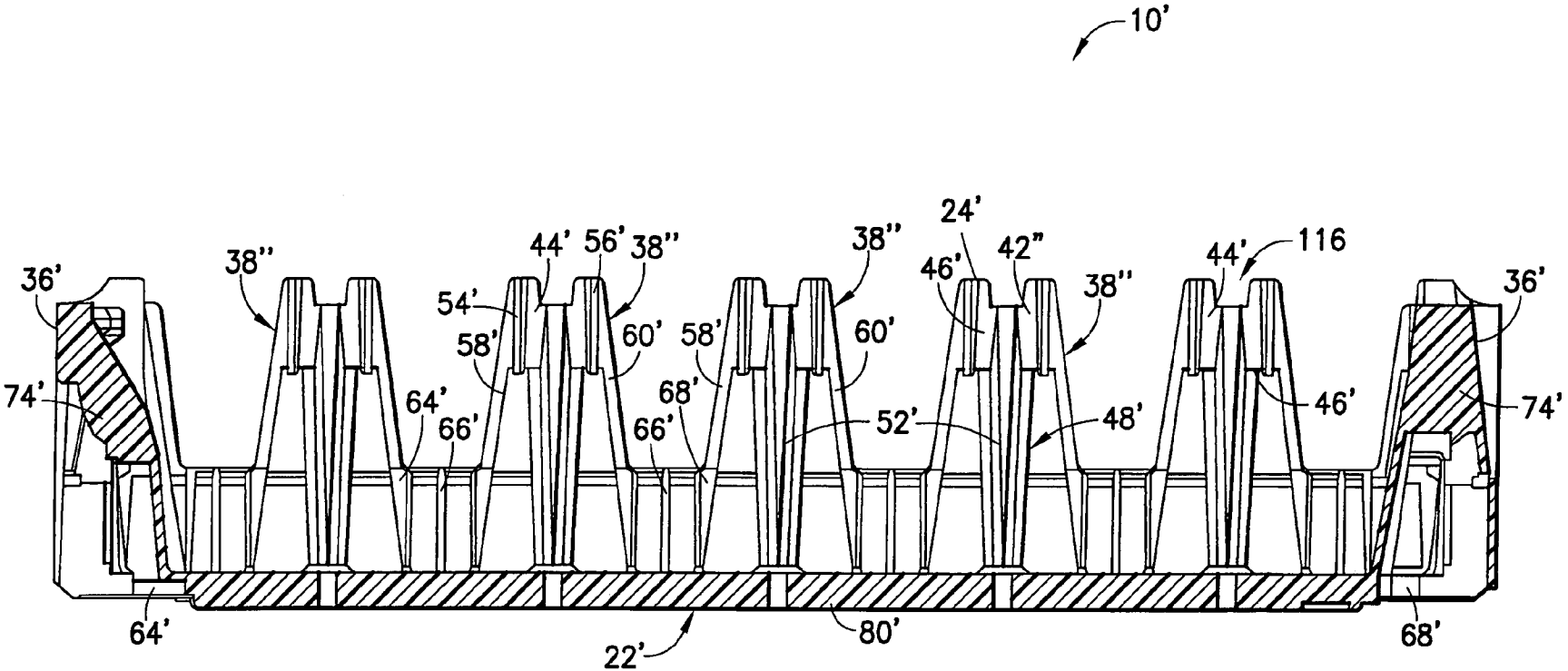
FIG. 12 is a section taken along the line 12-12 of FIG. 10 in a preferred embodiment of a crate in accordance with the invention.

FIGS. 10-12 illustrate an alternate embodiment of low depth bottle crate 10' of the present invention. In this embodiment, notches 116 may be added to side and end wall columns 38" and 38'" to receive nesting rib 106', an inwardly angled surface 119 may be included on the part 115 of the two columns 38'" adjacent handle bar 36' that extends above top surface 118 of handle bar 36', and radius supports 120 may be disposed on inner surface 121 of handle bar 36' to support bottles. The remaining features of crate 10' are otherwise the same as in the embodiments discussed above.

Still referring to FIGS. 10-12, low depth bottle crate 10' includes a crate bottom 22', a peripheral wall 12' joined with and extending upwardly from crate bottom 22', and a plurality of columns 38", 38'" and 40'. Crate bottom 22' typically includes an upper surface 23 devoid of interior columns and a lower surface 25. Columns 38" and 38'" have notches 116 which are adapted such that nesting ribs 106' fit within notch 116.

Peripheral wall 12' is also as described above, joining with and extending upwardly from the crate bottom 22'. Peripheral wall 12' includes a pair of opposing side walls 14' and 16' and a pair of opposing end walls 18' and 20'. Each of the opposing side and end walls includes upper and a lower portions 13 and 15. Ledge 32' separates upper portion 15 of peripheral wall 12 from the lower portion 13 of the peripheral wall 12. Lower portion 13 may be formed as a solid continuous band with the exception of handle cut-outs 34' in end walls 18' and 20'. Upper portion 15 includes a plurality of substantially U-shaped cut-outs 26' and a plurality of columns 38" and 38'" defined between cut-outs 26'.

Plurality of columns 38", 38'" and 40', defined between plurality of substantially U-shaped cut-outs 26', are also as described above with the addition of notches 116 located within columns 38" and 38'". Said plurality of columns include columns disposed on the side walls 38", columns disposed on the end walls 38'" and columns disposed at the four corners of the crate 40'. Each of columns 38", 38'" and 40' include an exterior top surface 24' and an internal area 122. Each of the columns 38" disposed within the opposing side walls 14' and 16' and each of the columns 38'" disposed within opposing end walls 18' and 20' (that is each of the columns except the four corner columns 40') includes a notch 116 defined along external top surface 24'.

Notches 116 are located in the center of exterior top surface 24' of columns 38" and 38'". Notches 116 are substantially U-shaped with the base 117 of U-shaped notch 116 substantially parallel to upper surface 23 of the crate bottom 22'. Base 117 of U-shaped notch 116 is positioned at approximately the same height relative to crate bottom 22' as external top surface 24' of corner columns 40'. The portion of columns 38" and 38'" immediately adjacent notches 116 thus extends above the height of corner columns 40'. A notch as in the present invention may be of varying size, shape and depth. Notch 116 is of relatively shallow depth extending approximately ⅛ of the distance from ledge 32' to external top surface 24'. Notch 116 is approximately ⅓ of the width of the upper portion of the columns 38" and 38'".

The crate of FIGS. 10-12 also includes nesting ribs 106' and 112' which are as described above. Nesting ribs 106' are located within internal area 122 of columns 38". Similarly, nesting ribs 112' are located within internal area 122 of corner columns 40'. Nesting ribs 106' and 112' are positioned above lower surface 25 of the crate bottom and below external top surface 24' of columns 38", 38'" and 40'. In crate 10', nesting ribs 106' and 112' terminate at lower edges 108' and 114'. In crate 10' lower edges 114' are positioned slightly above lower edges 108' with each edge disposed above the ledge 32' that separates upper portion 15 of the peripheral wall 12' from lower portion 13 of peripheral wall 12'. In an alternative embodiment lower edges 108' and 114' may be positioned at the same height relative to each other. In crate 10', nesting ribs 106' are bisected by longitudinal ribs 110' with longitudinal ribs 110' disposed perpendicular to nesting rib 106'. When crate 10' is nested atop an identical empty crate, nesting rib 106' fits within notches 116 engaging base 117 of U-shaped notch 116.

Columns 38" and 38'" may include support buttresses 48'. The structure and position of support buttresses 48' is as described above. Support buttresses 48' extend downwardly and inwardly from lower edge 46' of hollow cap 42' to crate bottom 22'.

Each of the plurality of columns defined within side walls 38" and end walls 38'" may extend above the external top surface 24' of corner columns 40'. In the crate of FIGS. 10-12, side and end wall columns 38" and 38'" extend above external top surface 24' of corner columns 40' by an amount equal to the depth of notches 116.

As also described above, U-shaped cut-outs 26' terminate at ledge 32' that separates upper portion 15 of peripheral wall 12' from lower portions 13 of the peripheral wall 12'. Lower portions 13 of peripheral walls 12' may be connected to crate bottom by groups of three ribs 64', 66' and 68'. Each of these groups of three ribs 64', 66' and 68' may be arranged directly below one of U-shaped cut-outs 26', and each of the groups of three ribs 64', 66' and 68' may extend vertically along said peripheral wall 12' from each of U-shaped cut-outs 26' to crate bottom 22'.

Handle cut-outs 34' may be defined in the lower portions of end walls 18' and 20'. Handle cut-outs 34' define handle bars 36' that extend between two of end wall columns 38'". Handle bars 36' are disposed directly above handle cut-outs 34'. Handle bar 36' includes a top surface 118 substantially parallel to upper surface 23 of crate bottom 22'.

Still referring to FIGS. 10 and 11, parts 115 of columns 38'" extend above the top surface 118 of the handle bar 36'. Included among the parts 115 of columns 38'" that extend above top surface 118 of handle bar 36' are inwardly angled portions 119. Inwardly angled portions 119 are positioned on the exterior surface of columns 38'", abutting U-shaped notches 116 and extending above base 117 of U-shaped notches 116. Inwardly angled portions 119 may be of varying pitch. In the crate 10', inwardly angled portions 119 are angled inward at an angle of approximately 45° relative to the upper surface of the crate bottom. While the term angled typically connotes a linear surface, as used herein, the term angled embraces convex and concave surfaces that depart inward from the plane of the exterior surface of the columns. Thus angled portion 119 may be linear or it may be slightly arced. Exterior top surface 24' of columns 38'" is positioned atop inwardly angled portion 119 and includes a flat surface substantially parallel to the upper surface of the crate bottom 22'.

As also described above, handle bar 36' may include a strut 74' extending from said midpoint of handle bar 36' to crate bottom 22'.

Referring specifically to FIG. 10, handle bar 36' includes an inner surface 121. An alternative embodiment of the crate as in the present invention may include radius supports 120 disposed on inner surface 121 of handle bar 36'. As used herein, the term radius support refers to a structure disposed on the inner surface of the handle bar that provides support for bottles stored adjacent the handle bar. Radius supports may be of varying size, shape and position. The crate of FIGS. 10 and 11 includes two radius supports 120 for each handle bar, one disposed at each end of handle bar 36'. Radius supports could, however, be positioned anywhere along the length of handle bar 36'. In one possible configuration, a single radius support could be positioned centered along the length of each handle bar. In the crate of FIGS. 10 and 11 radius supports 120 are comprised of inwardly positioned bands 124 that are approximately ⅓ of the width and ⅕ of the length of the handle bar. A narrow strip 126 connects one end of each band to the handle bar, the other end of each band is connected directly to adjacent columns 38'". A second narrow strip 128 connects the lower edge of the band to the inner surface of the handle bar. The second narrow strip may include a drainage hole 130. The top surface of the radius supports 120 is flush with the top surface of handle bar 36'. The overall configuration of bands 124 and strips 126 and 128 results in radius supports with a cup like structure. As mentioned, radius supports can be of varying shape and position. Radius supports are not limited to a cup like structure and may include solid structures, hollow structures, inverted cup structures, and/or a simple band connecting columns 38''' to handle bar 36'. The portion of radius supports 120 that contacts bottles may be curved to conform to the shape of the bottles they are intended to support.

In use, the crate of FIGS. 10, 11 and 12 confers substantial advantages. Notch 116 facilitates storage when crates are empty and nested without compromising bottle support. The columns of the crate of FIGS. 10, 11 and 12 provide bottle support along the full height of the column but the crates do not require any more storage space when the crates are nested than would a crate with columns that extend only to the base of notch 116. Notch 116 thus increases the effective height of the tray without increasing required storage space. Inwardly angled portion 119 provides additional clearance for bottle packaging equipment. This additional clearance is particularly useful when beverage crates are stored in handle to handle and adjacent to each other in that it allows machines to separately lift and transport stacks of adjacent beverage crates. Radius supports 120 strengthen the handle bar and provide additional support for transported bottles. In the absence of radius supports 120, transported bottles stored adjacent to the handle bar are prone to leaning out of the crate. Radius supports 120 prevent such bottles from leaning.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A low-depth bottle crate comprising:

a crate bottom, said crate bottom having an upper surface and a lower surface, said upper surface being devoid of any interior columns;

an outer peripheral wall joined with and extending upwardly from said crate bottom, said peripheral wall including a pair of opposing side walls and a pair of opposing end walls, each of said opposing side and end walls having an upper and lower portion, said lower portion of said side walls being solid about said peripheral wall, and said upper portion of said opposing side and end walls including a plurality of substantially U-shaped cut-outs;

a plurality of columns each of which are defined between two of said plurality of substantially U-shaped cut-outs, each of said plurality of columns having an external top surface and an internal area;

a notch defined along said external top surface of one or more of said plurality of columns, said notch including a base extending from the outer peripheral wall to an inner support wall; and a nesting rib located within said internal area of one or more of said plurality of columns, said nesting rib positioned above said lower surface of said crate bottom and below said external top surface of said plurality of columns, said nesting rib configured so as to fit within said notch and engage said base of said notch when said crate is nested on top of an identical empty crate said plurality of columns includes four corner columns disposed at four corners of said crate, and wherein each of said plurality of columns defined within said opposing side and end walls extends above said external top surface of each of said four corner columns.

2. A crate as in claim 1, wherein said plurality of columns includes four corner columns disposed at four corners of said crate and wherein each of said plurality of columns, except said four corner columns, has a support buttress extending downwardly and inwardly from said plurality of columns to said crate bottom.

3. A crate as in claim 2, wherein said U-shaped cut-outs terminate at a ledge that separates said upper portions of said opposing side and end walls from said lower portions of said opposing side and end walls, and further wherein said lower portions of said opposing side and end walls are connected to said crate bottom by groups of three ribs, each of said groups of three ribs arranged directly below one of said U-shaped cut-outs, and each of said groups of three ribs extending vertically along said peripheral wall from each of said U-shaped cut-outs to said crate bottom.

4. A crate as in claim 1, further comprising handle cut-outs defined in said lower portions of said opposing end walls, said handle cut-outs defining handle bars that extend between two of said plurality of columns in said opposing end walls, said handle bars disposed directly above said handle cut-outs.

5. A crate as in claim 4, wherein said handle bar includes a top surface and wherein said two of said plurality of columns include a part that extends above said top surface of said handle bar.

6. A crate as in claim 5, wherein said part of said two of said plurality of columns extending above said top surface of said handle bars includes an inwardly angled portion.

7. A crate as in claim 6, wherein each of said handle bars includes a midpoint and wherein a strut connects said midpoint to said crate bottom.

8. A crate as in claim 4, wherein said handle bar includes an inner surface, radius supports are disposed on said inner surface of said handle bar, and said radius supports provide support for retained bottles.

9. A crate as in claim 8, wherein said radius supports are curved to conform to the shape of retained bottles.

10. A crate as in claim 9, wherein said radius supports connect said inner surface of said handle bar to said two of plurality of columns.

11. A crate as in claim 6, wherein said handle bar includes an inner surface, radius supports are disposed on said inner surface of said handle bar, and said radius supports provide support for retained bottles.

12. A crate as in claim 11, wherein said radius supports are curved to conform to the shape of retained bottles.

13. A crate as in claim 12, wherein said radius supports connect said inner surface of said handle bar to said two of said plurality of columns.

14. A crate as in claim 11, wherein:

said U-shaped cut-outs terminate at a ledge that separates said upper portions of said opposing side and end walls from said lower portions of said opposing side and end walls; and said lower portions of said opposing side and end walls are connected to said crate bottom by groups of three ribs, each of said groups of three ribs arranged directly below one of said U-shaped cut-outs, and each of said groups of three ribs extending vertically along said peripheral wall from said U-shaped cut-outs to said crate bottom.

* * * * *

UNITED STATES PATENT AND TRADEMARK OFFICE

CERTIFICATE OF CORRECTION

PATENT NO. : 7,578,410 B2
APPLICATION NO. : 10/958518
DATED : August 25, 2009
INVENTOR(S) : Stahl et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 281 days.

Signed and Sealed this

Seventh Day of September, 2010

David J. Kappos

David J. Kappos
*Director of the United States Patent and Trademark Office*